US011524819B2

(12) United States Patent
Morris et al.

(10) Patent No.: US 11,524,819 B2
(45) Date of Patent: Dec. 13, 2022

(54) LEAK-PROOF PRESS-FIT SEALED CONTAINER

(71) Applicant: The Hillshire Brands Company, Chicago, IL (US)

(72) Inventors: Steven W. Morris, Bentonville, AR (US); Jeffrey Czarny, Chicago, IL (US); Mary Lou Resh, Chicago, IL (US)

(73) Assignee: THE HILLSHIRE BRANDS COMPANY, Chicago, IL (US)

( * ) Notice: Subject to any disclaimer, the term of this patent is extended or adjusted under 35 U.S.C. 154(b) by 291 days.

(21) Appl. No.: 16/023,279

(22) Filed: Jun. 29, 2018

(65) Prior Publication Data

US 2019/0002169 A1 Jan. 3, 2019

Related U.S. Application Data

(60) Provisional application No. 62/526,972, filed on Jun. 29, 2017.

(51) Int. Cl.

| | |
|---|---|
| ***B65D 45/32*** | (2006.01) |
| ***B65B 7/28*** | (2006.01) |
| ***B65D 51/24*** | (2006.01) |
| ***B65D 85/00*** | (2006.01) |
| ***B65D 77/30*** | (2006.01) |

(Continued)

(52) U.S. Cl.

CPC ..... *B65D 45/32* (2013.01); *B65B 7/2842* (2013.01); *B65D 1/36* (2013.01); *B65D 43/164* (2013.01); *B65D 51/24* (2013.01); *B65D 65/16* (2013.01); *B65D 77/202* (2013.01); *B65D 77/2012* (2013.01); *B65D 77/30* (2013.01); *B65D 85/70* (2013.01)

(58) Field of Classification Search

CPC ..... B65D 77/202

See application file for complete search history.

(56) References Cited

U.S. PATENT DOCUMENTS 2,041,537 A * 5/1936 Frost ..... B65D 43/0212 229/125.13
3,056,525 A * 10/1962 Deinert ..... B65D 25/04 220/507

(Continued)

FOREIGN PATENT DOCUMENTS

FR 2763047 A1 * 11/1998 ..... B65B 7/162
FR 2816590 A1 * 5/2002 ..... B65D 55/024

*Primary Examiner* — Viren A Thakur
*Assistant Examiner* — Thanh H Nguyen
(74) *Attorney, Agent, or Firm* — Duane Morris LLP

(57) ABSTRACT

An apparatus is disclosed. The apparatus includes a tray having a base connected to a plurality of sidewalls each of which extends away from the base and terminates at a rim, said tray defining a volume with an opening circumscribed by said rim, said rim comprising a press-fit sealing feature; a ring-shaped lid comprising a complimentary press-fit sealing feature configured to mate with said press-fit sealing feature; a product disposed in said volume wherein said product surface comprises at least one contour; and a flexible film, said flexible film spans said opening and adheres to the at least one contour of the product, and said flexible film is secured to said tray between said press-fit sealing feature of the rim and said complimentary press-fit sealing feature of the ring-shaped lid.

24 Claims, 11 Drawing Sheets

(51) Int. Cl.

| | |
|---|---|
| ***B65D 1/36*** | (2006.01) |
| ***B65D 43/16*** | (2006.01) |
| ***B65D 65/16*** | (2006.01) |
| ***B65D 77/20*** | (2006.01) |

(56) References Cited

U.S. PATENT DOCUMENTS

| | | | | |
|---|---|---|---|---|
| 3,221,692 | A * | 12/1965 | Seiferth | B65D 7/36<br>413/6 |
| 2015/0028033 | A1* | 1/2015 | Samuel | B65D 43/162<br>220/270 |

* cited by examiner

LEAK-PROOF PRESS-FIT SEALED CONTAINER

CROSS REFERENCE TO RELATED APPLICATIONS

The present application claims the benefit of U.S. Provisional App. No. 62/526,972 (filed on Jun. 29, 2017), which is hereby incorporated by reference.

BACKGROUND

In a conventional package or in a conventional packaging process, a product, such as fresh poultry, is placed in a tray or tub and covered with a plastic film such that the film totally encloses the tray and the product. Additionally, a conventional package may include a modified atmosphere for the product, although such atmospheric modification is not always performed and/or necessary. Typically, heat is then applied to a portion of the plastic film to seal the package. In certain conventional packages, the film is heat sealed to a heat seal flange or flanges on the tray or tub in a perimeter sealing arrangement. Applying heat to a package, however, unnecessarily exposes the food product in the tray to heat and thereby may have a negative impact on the shelf life of the food product.

Additionally, consumers prefer certain products to be packaged in such a manner that the food product is easily visible and protrudes above the rim of the tray or tub. This is particularly the case with poultry products. Such an arrangement increases the likelihood that a leak-proof seal cannot be made and/or maintained for the package. One reason is that the protrusion of the product above the tray may result in contamination of the heat seal flange(s) by, for example, the flange being wetted by liquid from the product.

Conventional food packages and/or packaging techniques are widely implemented in the food industry to package food products, such as fresh poultry, other meats, or other food. The poultry, meat, or other food product may include moisture, such as, but not limited to, liquids associated with the raw food product (e.g., "purge" and/or "chicken juice"). Since the plastic film typically adheres to itself, a somewhat leak-proof seal may be formed where the film overlaps itself without creating wrinkles or excessively folded film layers. Wrinkles and excessively folded layers adversely affect the sealing characteristics of the film thereby resulting in packages which are not sufficiently leak-proof or packages that may later develop leaks. Leakage of fluid from certain conventional food packages results in the tray bottom being wetted by the leaked fluid which may result in contamination of store shelves, food preparation surfaces, or require the store owner and/or consumer to take otherwise unnecessary steps to prevent such contamination. Additionally, a wet tray bottom creates an otherwise avoidable mess when the food package is opened thereby requiring the store owner or consumer to clean the surface where the food package was opened.

Conventional food packages typically use an EPS-foam tray and an overwrap film or a flow wrap film arrangement that is neither hermetic, leak-poof, nor airtight. Other conventional food packages use rigid or semi-rigid over-caps or lids on top of the underlying tray, where the over-caps or lids may include either an internal or external locking rib mechanism that does not allow direct access to the contained product without breaking the film or lid flange. Additionally, none of these arrangements typically provide a leak-proof seal. These are common problems in the industry. Furthermore, food product protruding above the sidewall of the tray, or overhanging over the side of the tray, increases the likelihood that the sealing flange of the tray will be contaminated with purge, food particles, or the like which will inhibit forming a seal using conventional heat sealing methods. Accordingly, there is a need for a food product package sealing system and/or method that provides a hermetic, leak-poof, and airtight sealed package without the use of heat in the vicinity of the food product, particularly for food products that protrude above the rim of the package tray.

SUMMARY

The above noted problems with conventional food packages can be overcome by the present disclosure which provides for a food product package comprising a tray and covering plastic film and/or a packaging method for such a food product package, where a leak-proof seal for the package is created by using a force-fit or press-fit arrangement without applying heat to the plastic film. In certain embodiments, the food product is visible to the consumer through the film and/or the tray. In other embodiments, the food product may protrude above the tray. In still other embodiments, where food particles contaminate the sealing flange, the sealing system creates an effective seal through such contamination. The press-fit package may additionally promote a novel easy open feature and further allow for reclosability. The system may also increase the use of recyclable materials and, in certain embodiments, may reduce the amount of non-recyclable materials used for the package by over 50%. These and other advantages are discussed in further detail below.

According to some embodiments, the manufacturing benefits of the present invention include creating a leak-proof seal without using heat, eliminating heat as it pertains to making a seal, and limiting product contamination. According to some embodiments, the consumer benefits of the present invention include: reducing moisture/fluid leakage which may cause stickiness of the package and surrounding areas; increasing durability of materials; reducing moisture/fluid leakage during home use; providing an easy to open and reclosable package; increasing product visibility through the packaging material. According to some embodiments, with the use of recyclable materials, the present invention reduces the amount of non-recyclable materials by over 50%. Furthermore, the press-fit sealing arrangement of the present inventive food package allows for the creation of a moisture/fluid seal despite the tray flange being wetted by moisture/fluid either from the food product, food product purge, or from some other source or from particles of the food product being deposited on the tray flange.

According to some embodiments, an apparatus is disclosed. The apparatus includes: a tray having a base connected to a plurality of sidewalls each of which extends away from the base and terminates at a rim, said tray defining a volume with an opening circumscribed by said rim, said rim comprising a press-fit sealing feature; a ring-shaped lid comprising a complimentary press-fit sealing feature configured to mate with said press-fit sealing feature; a product disposed in said volume wherein said product surface comprises at least one contour; and a flexible film, said flexible film spans said opening and, in an embodiment, adheres to the at least one contour of the product, and said flexible film is secured to said tray between said press-fit sealing feature of the rim and said complimentary press-fit sealing feature of the ring-shaped lid. According to some embodiments, the securing of said flexible film to said tray results in the tray being airtight and water tight. According to some embodiments, said flexible film is secured to said tray without the addition of heat to the apparatus. According to some embodiments, said product is visible through said flexible film and/or through both the tray and the film. According to some embodiments, said product protrudes from the volume past said opening. According to some embodiments, said press-fit sealing feature comprises a ridge element on said rim.

In some embodiments, the apparatus includes an additional flexible film. The additional flexible film may be a permanent film that is attached to the tray and may be located underneath a second flexible film attached to the ring lid. This additional flexible film can allow increased tamper resistance, for example, or can provide protection to product (e.g., food) within the tray from the atmosphere (e.g., a gas barrier, such as to prevent gasses, such as a modified atmosphere, from within the tray to escape). In some examples, the additional flexible film is attached to the ring lid. For example, the additional flexible film can be wrapped over the ring lid, or can be attached using a flow wrap operation. The additional flexible film can allow for brand identification, such as graphics or branding information that is located on the outside of the additional flexible film (e.g., viewable to the consumer).

According to some embodiments, said complementary press-fit sealing feature comprises a channel element on said ring-shaped lid. According to some embodiments, said press-fit sealing feature comprises a channel element on said rim. According to some embodiments, said complementary press-fit sealing feature comprises a ridge element on said ring-shaped lid. According to some embodiments, the apparatus further includes a ring-pull device attached to said ring-shaped lid for unsealing said apparatus. According to some embodiments, the apparatus further includes a corner tab feature on said ring-shaped lid, said corner tab is displaced to access said ring-pull device. According to some embodiments, the channel element further comprises a bottom. According to some embodiments, the bottom of the channel element further comprises at least one drain hole. Each drain hole allows for the egress of excess moisture, purge, or liquid, for example, upon the sealing of the apparatus. According to some embodiments, the bottom of the channel element is sloped toward the at least one drain hole.

According to some embodiments, an apparatus is disclosed. The apparatus includes a tray having a base connected to a plurality of sidewalls each of which extends away from the base and terminates at a rim, said tray defining a volume with an opening circumscribed by said rim, said rim comprising a press-fit sealing feature having a channel; a gasket configured to be disposed within said channel; a product disposed in said volume wherein said product surface comprises at least one contour; and a flexible film, said flexible film spans said opening and, in an embodiment, adheres to the at least one contour of the product, and said flexible film is secured to said tray between said press-fit sealing feature of the rim and said gasket. According to some embodiments, the securing of said flexible film to said tray results in the tray being airtight and water tight. According to some embodiments, said flexible film is secured to said tray without the addition of heat to the apparatus. According to some embodiments, product is visible through said flexible film and/or through both the tray and the film. According to some embodiments, said product protrudes from the volume past said opening. According to some embodiments, the apparatus further includes a ring-pull device attached to said gasket for unsealing said apparatus. According to some embodiments, the channel further comprises a bottom. According to some embodiments, the bottom of the channel further comprises at least one drain hole. According to some embodiments, the bottom of the channel is sloped toward the at least one drain hole.

According to some embodiments, a method for storing a product contained within a storage apparatus is disclosed. The method includes the steps of: providing a tray having a base connected to a plurality of sidewalls each of which extends away from the base and terminates at a rim, said tray defining a volume with an opening circumscribed by said rim, said rim comprising a press-fit sealing feature; providing a ring-shaped lid comprising a complimentary press-fit sealing feature configured to mate with said press-fit sealing feature; placing the product in said volume wherein said product surface comprises at least one contour; and providing a flexible film, said flexible film spans said opening and adheres to the at least one contour of the product, and said flexible film is secured to said tray between said press-fit sealing feature of the rim and said complimentary press-fit sealing feature of the ring-shaped lid. According to some embodiments, the securing of said flexible film to said tray results in the tray being airtight and water tight. According to some embodiments, said flexible film is secured to said tray without the addition of heat to the storage apparatus. According to some embodiments, said product is visible through said flexible film and/or through both the tray and the film. According to some embodiments, said product protrudes from the volume past said opening. According to some embodiments, said press-fit sealing feature comprises a ridge element on said rim. According to some embodiments, said complementary press-fit sealing feature comprises a channel element on said ring-shaped lid. According to some embodiments, said press-fit sealing feature comprises a channel element on said rim. According to some embodiments, said complementary press-fit sealing feature comprises a ridge element on said ring-shaped lid.

According to some embodiments, the method further includes a ring-pull device attached to said ring-shaped lid for unsealing said apparatus. According to some embodiments, the method further includes a corner tab feature on said ring-shaped lid, wherein said corner tab is displaced to access said ring-pull device. According to some embodiments, the method further includes removing the flexible film from the storage apparatus; and providing a second flexible film, wherein said second flexible film is secured to said tray between said press-fit sealing feature of the rim and said complimentary press-fit sealing feature of the ring-shaped lid. The second flexible film may be a plastic film provided by the consumer to reclose the package.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
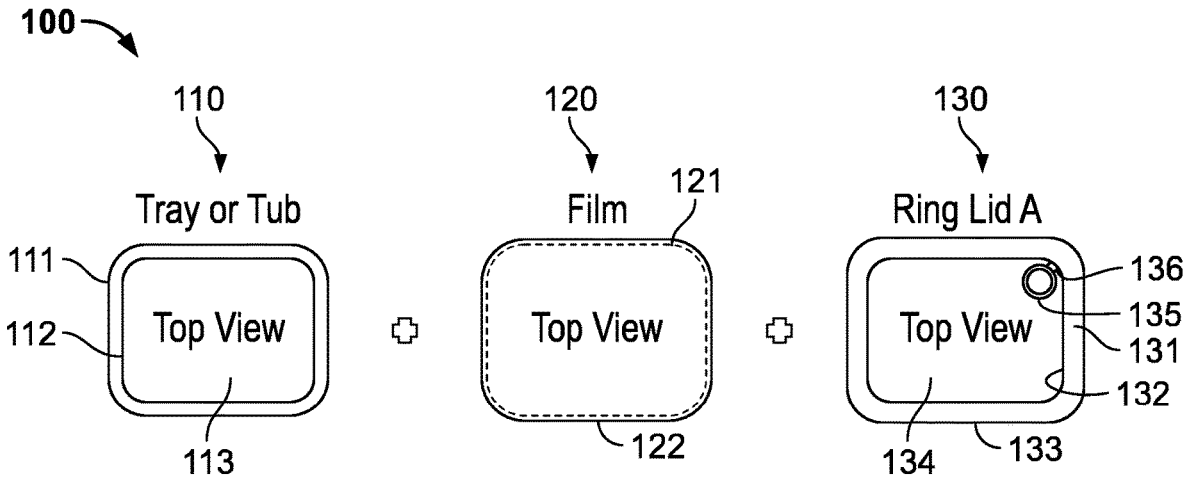
FIG. 1 is a schematic illustration of a plan view of a three-piece press fit sealing system, in accordance with some embodiments.

The following disclosure provides many different embodiments, or examples, for implementing different features of the subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a schematic illustration of a three-piece press fit sealing system, in accordance with some embodiments. According to some embodiments, a three-piece press fit sealing system 100 includes a tray or tub element 110 for holding food products, such as, but not limited to, fresh poultry, a flexible film element 120 to be placed over the tray, and a ring lid element 130 for sealing or locking the flexible film element 120 to the top of the tray such that food products contained in the tray or tub element 110 are sealed from an external environment by a leak-proof seal. This novel arrangement solves the sealing problem inherent with conventional food product packages where wetting of the heat sealing surface/flange of the tray (e.g., from either food product particles or from food product purge or fluid associated with the food product) or contamination of the heat sealing surface/flange with food particles prevents a leak-proof seal from being formed. As discussed above, when the food product protrudes above and over the rim of the tray, the likelihood of contamination of the heat sealing flange increases. The inventive arrangement disclosed herein solves this problem by creating a press-fit or forced-fit seal which seals through food particles, moisture, or food product purge, without the need for a heat seal. According to some embodiments, the three-piece press fit sealing system 100 is implemented for fresh poultry and is also applicable to products that do not require barrier packaging. In the top view of the tray or tub element 110, the tray or tub element 110 includes a base 113, a plurality of enclosing side walls 112 and a top rim 111. According to some embodiments, the plurality of enclosing side walls 112 extend away from the base 113 and terminate at the top rim 111. These features can also be seen, e.g., in FIGS. 4-8 and 12.

According to some embodiments, the top view of the tray or tub element 110 is rectangular with rounded corners. According to other embodiments, other shapes are contemplated for the tray or tub element 110. According to other embodiments, at least one sealing feature is implemented on the top rim 111. The details of the sealing feature will be discussed below with respect to FIGS. 4-6 and other Figs. According to some embodiments, the flexible film element 120 has a matching (or substantially matching) shape and size corresponding to the tray or tub element 110. The dashed line 121 generally matches the outer edge of the rim 111 of the tray or tub element 110. The edge 122 of film element 120 provides an additional amount of film to allow for adequate material to make a seal with the rim 111, as will be discussed below. According to some embodiments, the flexible film element 120 is transparent, semi-transparent, or not transparent. According to some embodiments, the flexible film element 120 is printed. According to some embodiments, the flexible film element 120 is not printed.

According to some embodiments, the ring lid element 130 is used for sealing or locking the flexible film element 120 to the rim 111 of tray 110 as will be discussed below. The ring lid element 130 has a matching size and shape corresponding to the rim 111 of tray or tub element 110. In an embodiment, the ring lid element 130 has an outer rim 131 and an inner rim 132, the ring lid body 133, a hollow internal opening 134, a pull-ring 135 for pulling open the ring lid, and a pull-ring connector 136 for connecting the pull-ring 135 with the ring lid body 133. According to some embodiments, the pull-ring 135 is connected to the ring lid 130 on one of the four corners of the rounded rectangular shape. The pull-ring 135 is located inside the perimeter of the rounded rectangular shape of the ring lid 130. According to other embodiments, the pull-ring 135 is connected to the ring lid 130 at other appropriate places.

According to some other embodiments, the three-piece press fit sealing system 100 is a leak-proof seal system formed without the use of heat. As discussed above, heating is used in conventional sealing systems, but the use of heat in sealing packages which include some products, such as fresh produce, meat, etc., is not desired. A sealing system without using heat is useful for products in which it is not desirable to use heat during sealing. The three-piece press fit sealing system 100 creates a leak-proof seal and is further useful in preventing contamination of the food products sealed within. Further, in certain embodiments the film in the three-piece press fit sealing system 100 adheres to product contours without negatively impacting the seal-ability of the film. The sealing system further allows for sealing through moisture, food product purge, and contamination.

The use of the pull-ring 135, or a corner tab (described further below with respect to FIGS. 13, 14, and 15), allows the three-piece press fit sealing system 100 to be easily opened by a consumer. Additionally, use of a pull ring and/or corner tab enhances the tamper evident/tamper resistant features of the package. The three-piece press fit sealing system 100 also eliminates the use of expanded polystyrene. The three-piece press fit sealing system 100 produces an airtight wet pack without film heating or the need to use a shrink tunnel. The three-piece press fit sealing system 100 also allows a consumer to access some of the product in the package, then reclose the package (with the remaining product inside) by using the same piece of flexible film (e.g., supplied by the producer), or a different piece of flexible film (e.g., supplied by the consumer) with the tray 110 and ring lid 130. The different piece of flexible film may be, for example, standard plastic wrap. Thus, the product package described above may be reusable and recloseable by the consumer, for example, for storage of unused existing product (e.g., food) or subsequent secondary use as determined by the consumer. Further implementation details of the three-piece press fit sealing system will be discussed below.

Figure 2:
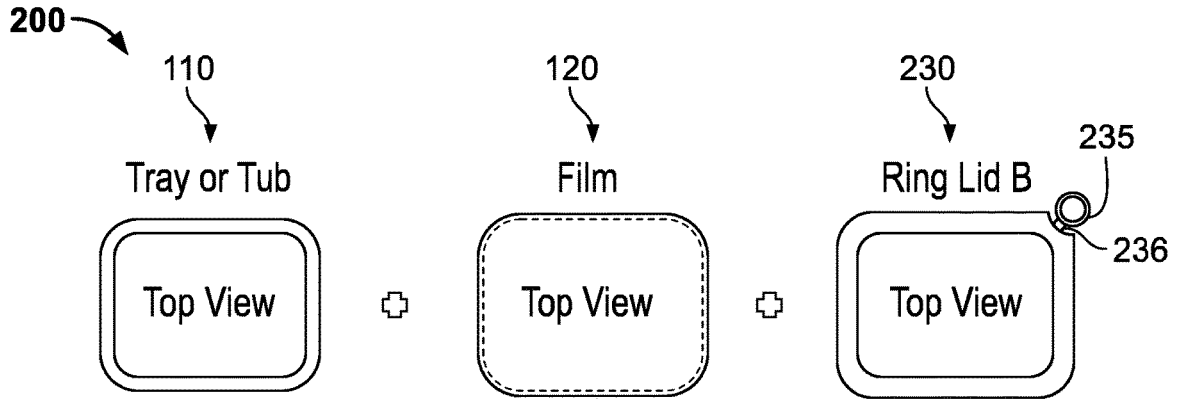
FIG. 2 is a schematic illustration of a plan view of another three-piece press fit sealing system, in accordance with some embodiments.

FIG. 2 is a schematic illustration of another three-piece press fit sealing system, in accordance with some embodiments. According to some embodiments, the three-piece press fit sealing system 200 is similar to the embodiment illustrated in FIG. 1, the difference is that the pull-ring 235 is connected to the ring lid 230 through connector 236 and the pull-ring 235 is located outside the perimeter of the rounded rectangular shape of the ring lid 230.

Figure 3:
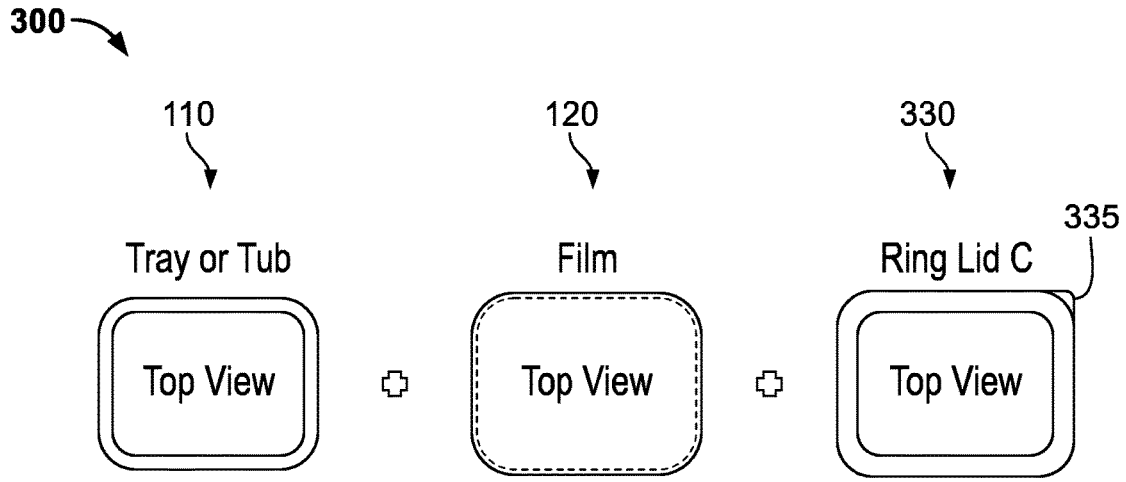
FIG. 3 is a schematic illustration a plan view of another three-piece press fit sealing system, in accordance with some embodiments.

FIG. 3 is a schematic illustration of another three-piece press fit sealing system, in accordance with some embodiments. According to some embodiments, the three-piece press fit sealing system 300 is similar to the embodiment illustrated in FIG. 1, the difference is that instead of a pull-ring 135, a pull-tab 335 is implemented to serve the function of pulling open the ring lid 330. The pull tab 335 will be discussed in more detail below with respect to FIG. 11. Certain embodiments discussed with respect to FIGS. 13-15 will disclose additional details of pull tab 335.

Figure 4:
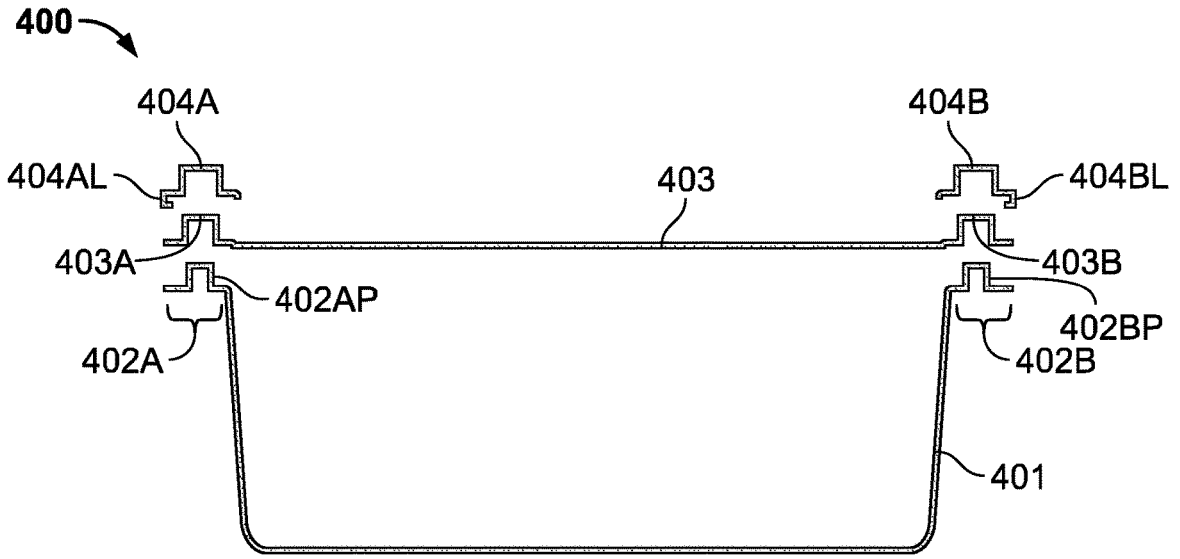
FIG. 4 is a schematic illustration of an elevation cross-sectional view of a male-fit three-piece press fit sealing system, in accordance with some embodiments.

FIG. 4 is a schematic illustration of an elevation cross-sectional view of a male-fit three-piece press fit sealing system, in accordance with some embodiments. According to some embodiments, the male-fit three-piece press fit sealing system 400 includes a tray or tub element 401, which, in addition to the tray or tub bottom and side walls discussed in FIG. 1, further includes male fit top rims (or seal flanges) 402A and 402B. The top views of the top rims 402A and 402B are illustrated in FIG. 1 generally as element 111. The male fit top rims 402A and 402B include protrusions 402AP and 402BP for protruding into the ring lid 404A and 404B. The protrusions 402AP and 402BP are sealing features discussed earlier implemented on the top rims. A flexible film 403 is deployed on the top of the tray or tub 401 and over the top rim protrusions 402AP and 402BP to form corresponding structures 403A and 403B. A ring lid 404A/B is deployed on the top of the film and the top protrusions 402AP and 402BP to seal the film 403 in place. In an embodiment, the flexible film may act as a shoehorn to guide the protrusions 402AP and 402BP into the corresponding channels 404A and 404B in the ring lid. In a further embodiment, the flexible film assists/enhances the sealing or bonding between the tray and ring lid by filling voids between the tray and ring lid and/or by creating extra tension in the sealing arrangement. The top view of the ring lid 404A/B is illustrated generally as 133 in FIG. 1. The ring lid 404A/B includes matching structures for tightly receiving the top rim protrusions 402AP and 402BP. The size and structure of the ring lid 404A/B matches the size and structure of the top rim protrusions on the top rim 402A/B to form a press-fit seal, the film 403 being tightly sealed between the ring lid 404A/B and the top rim 402A/B.

In certain embodiments, a latching mechanism 404AL and 404BL (which in an embodiment may be a continuous structure around the ring lid) of the ring lid may be formed so as to engage the outer edge of top rims 402A and 402B, respectively.

In some embodiments, ring lid 404A/B includes an additional flexible film (not shown). For example, the additional flexible film may be a permanent film that is attached to ring lid 404A/B or to tray or tub 401. The additional flexible film can be wrapped over the ring lid 404A/B, or can be attached using a flow wrap operation. The additional flexible film can allow for brand identification, such as graphics or branding information that is located on the outside of the additional flexible film (e.g., viewable to the consumer).

Figure 5:
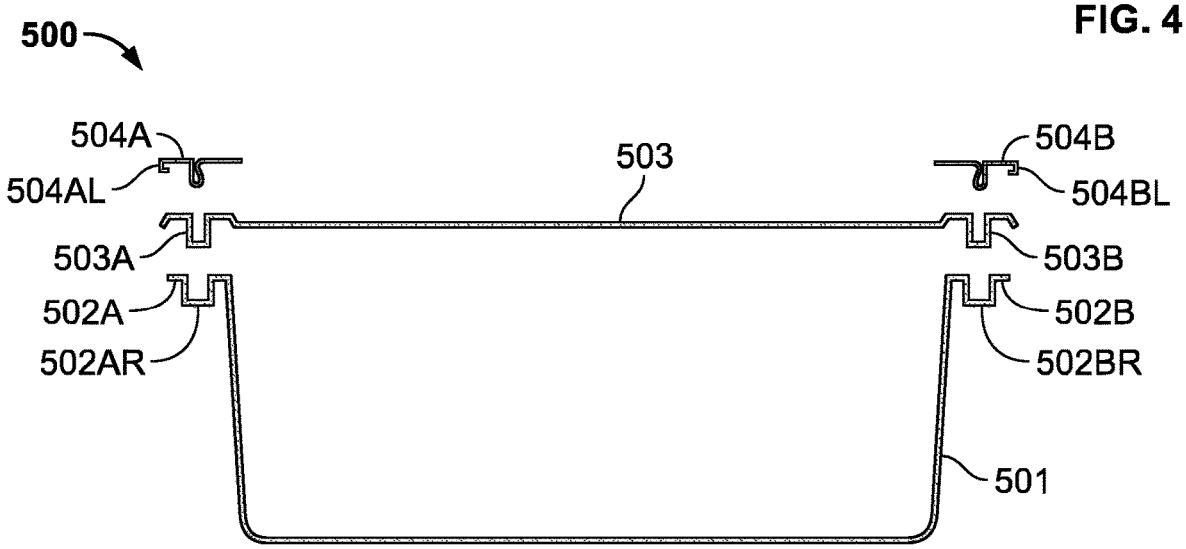
FIG. 5 is a schematic illustration of an elevation cross-sectional view of a female-fit three-piece press fit sealing system, in accordance with some embodiments.

FIG. 5 is a schematic illustration of an elevation cross-sectional view of a female-fit three-piece press fit sealing system, in accordance with some embodiments. According to some embodiments, the female-fit three-piece press fit sealing system 500 is similar to the male-fit three-piece press fit sealing system 400, the difference being that instead of protrusions, recesses (e.g., grooves) 502AR and 502BR are deployed on the top rims 502A/B to receive the protrusions on the ring lid 504A/B. The recesses 502AR and 502BR are sealing features discussed earlier implemented on the top rims. A flexible film 503 is covered on the top of the tray or tub 501 and over the top rim recesses 502AR and 502BR to form corresponding structures 503A and 503B. In addition, ring lid with protrusions 504A/B (which may be the same shape as corresponding recesses 502AR and 502BR or may be a different shape so long as a seal can be formed as discussed herein) is deployed on the top of the film 503. In an embodiment, the protrusions 504A/B on the ring lid have size and structure matching the size and structure of the top rim 502A/B. The size and structure of the ring lid 504A/B match the size and structure of the top rim protrusions on the top rim 502A/B to form a press-fit seal, the film 503 being tightly sealed between the ring lid 504A/B and the top rim 502A/B.

In certain embodiments, a latching mechanism 504AL and 504BL (which in an embodiment may be a continuous structure around the ring lid) of the ring lid may be formed so as to engage the outer edge of top rims 502A and 502B, respectively.

Figure 6:
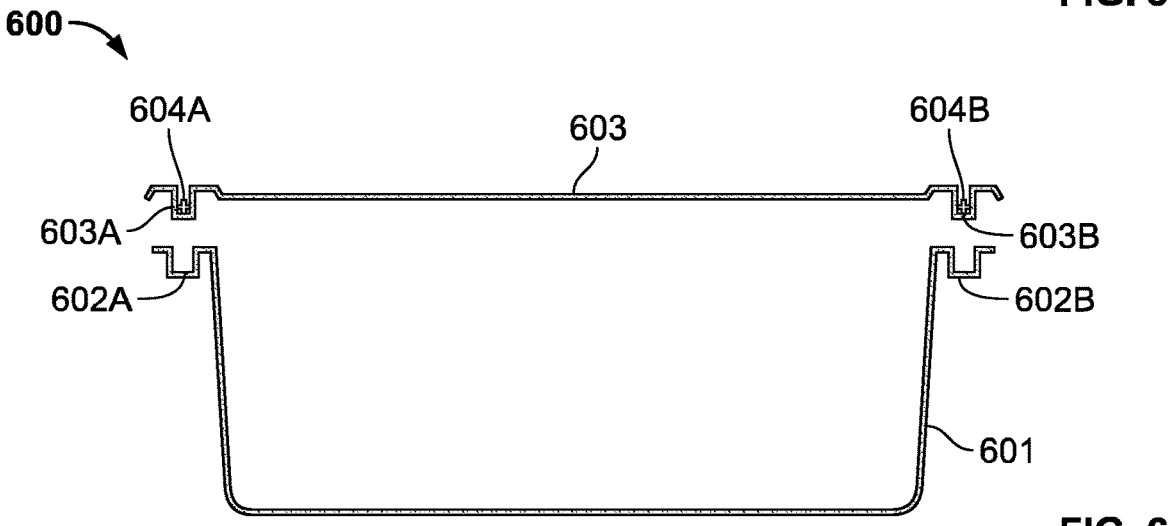
FIG. 6 is a schematic illustration of an elevation cross-sectional view of a gasket-fit three-piece press fit sealing system, in accordance with some embodiments.
Figure 11:
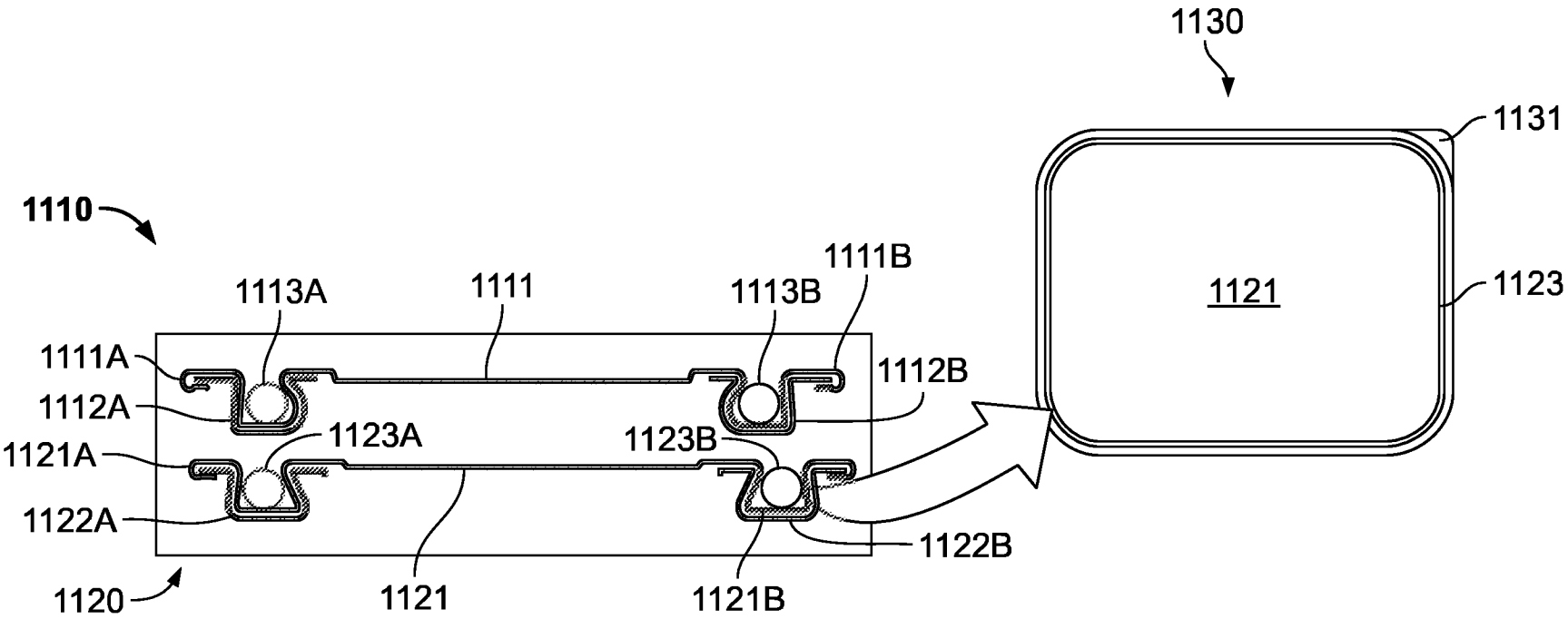
FIG. 11 is a schematic illustration of an elevation cross-sectional view of the gasket options for the angled press fit option and the curved press fit option, in accordance with some embodiments.

FIG. 6 is a schematic illustration of an elevation cross-sectional view of a gasket-fit three-piece press fit sealing system, in accordance with some embodiments. A flexible film 603 is covered on the top of the tray or tub 601 and over the top rim recesses 602A and 602B to form corresponding structures 603A and 603B. According to some embodiments, the gasket-fit three-piece press fit sealing system 600 is similar to the female-fit three-piece press fit sealing system 500, the difference being that instead of a ring lid with protrusions, a gasket ring 604A/B is deployed on the top of the flexible film 603 inside the recesses 602A/B. The gasket ring 604A/B has matching size and structure to fit into the recesses 602A/B tightly to form a press-fit seal. The recesses 602A/B are the sealing features discussed earlier implemented on the top rims. A top view of the gasket ring is illustrated in FIG. 11.

Figure 7:
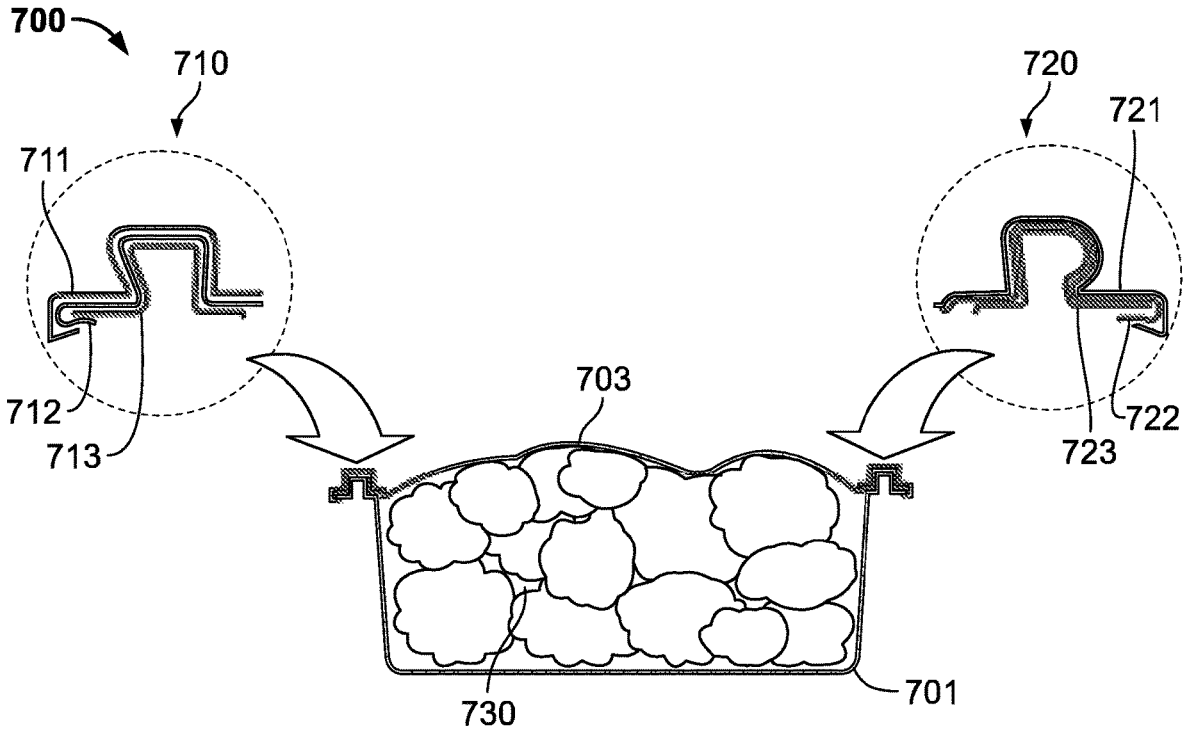
FIG. 7 is a schematic illustration of an elevation cross-sectional view of a male-fit three-piece press fit sealing system with enlarged views of an angled press fit option and a curved press fit option, in accordance with some embodiments.

FIG. 7 is a schematic illustration of an elevation cross-sectional view of a male-fit three-piece press fit sealing system with enlarged views of an angled option and a curved option, in accordance with some embodiments. According to some embodiments, the male fit three-piece press fit sealing system 700 employs an angled option sealing feature 710 for the protrusion on the top rim. According to some embodiments, the male fit three-piece press fit sealing system 700 employs a curved option sealing feature 720 for the protrusion on the top rim. As illustrated, when the tray or tub 701 is filled with food product 730, the flexible film 703 is covered on the top of the food product 730 and stretched to show the contour of the food product 730. When the top rim employs the angled option sealing feature 710, the top rim forms angled configuration 713, and the ring lid employs a matching angled configuration 711. The film 712 is spread between the 713 and 711 to form a press-fit seal, the ring lid engages over the tray or tub 701, trapping the film 703 thereby sealing the package. Similarly, when the top rim employs the curved option sealing feature 720, the film 722 is spread between the 723 and 721 to form a press-fit seal, the ring lid engages over the tray or tub 701, trapping the film 703 thereby sealing the package. According to some embodiments, the angled option and the curved option have a plurality of variations in shape and size. Since the flexible film is stretched over the top of the tray, the flexible film will be under tension which will act to pull the seal flange (either angled 710 or curved 720) inward towards the center of the tray. Therefore, a torque will be created in the seal flange. In certain embodiments, the angled sealing feature 710 and/or the curved sealing feature 720 will have the respective angled/curved section pointed outward from the center of the tray (as shown in FIG. 7) in order to help maintain the seal due to the torque on the seal flange.

Figure 8:
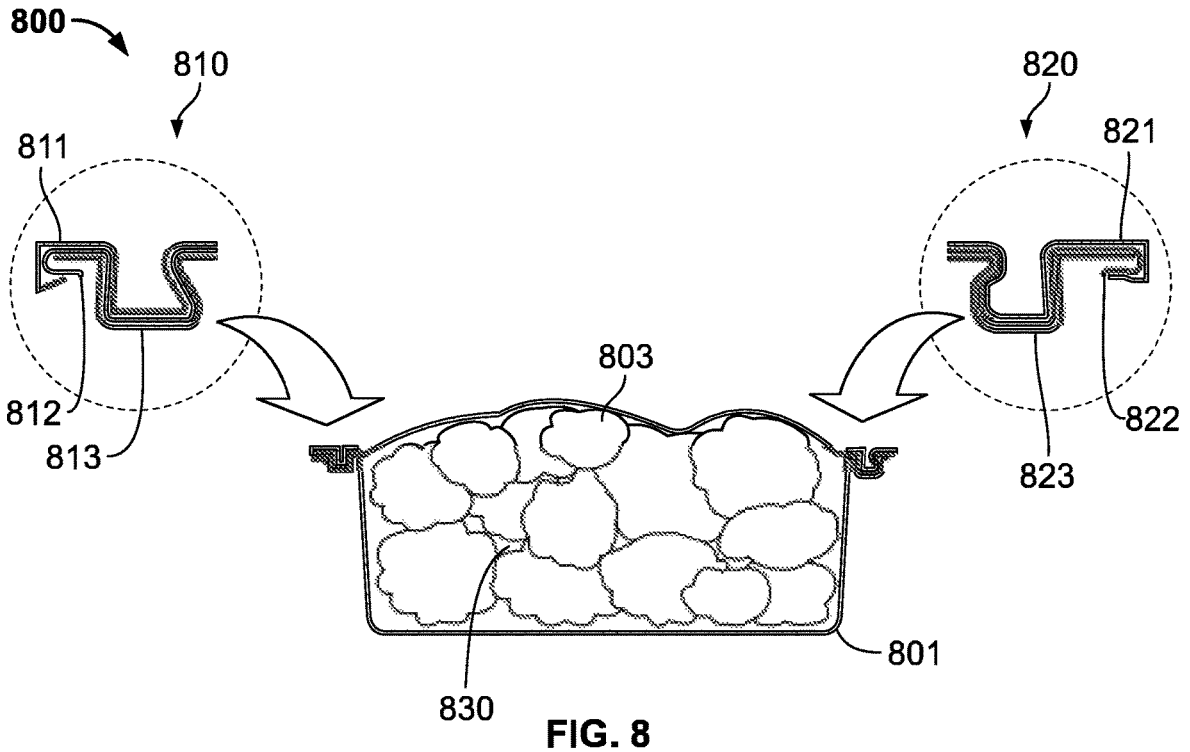
FIG. 8 is a schematic illustration of an elevation cross-sectional view of a female-fit three-piece press fit sealing system with enlarged views of an angled press fit option and a curved press fit option, in accordance with some embodiments.

FIG. 8 is a schematic illustration of an elevation cross-sectional view of a female-fit three-piece press fit sealing system with enlarged views of an angled option and a curved option, in accordance with some embodiments. According to some embodiments, the female-fit three-piece press fit sealing system 800 is very similar to the male-fit three-piece press fit sealing system 700 illustrated in FIG. 7. The difference is that, instead of a male fit top rim, the system 800 has a female-fit top rim. According to some embodiments, the female-fit top rim employs an angled option sealing feature 810 in which the film 812 is sealed between the recess 813 and the matching ring lid 811. According to some embodiments, the female-fit top rim employs a curved option sealing feature 820 in which the film 822 is sealed between the recess 823 and the matching ring lid 821. Since the flexible film is stretched over the top of the tray, the flexible film will be under tension which will act to pull the seal flange (either angled 810 or curved 820) inward towards the center of the tray. Therefore, a torque will be created in the seal flange. In certain embodiments, the angled sealing feature 810 and/or the curved sealing feature 820 will have the respective angled/curved section pointed inward toward the center of the tray (as shown in FIG. 8) in order to help maintain the seal due to the torque on the seal flange.

Figure 9:
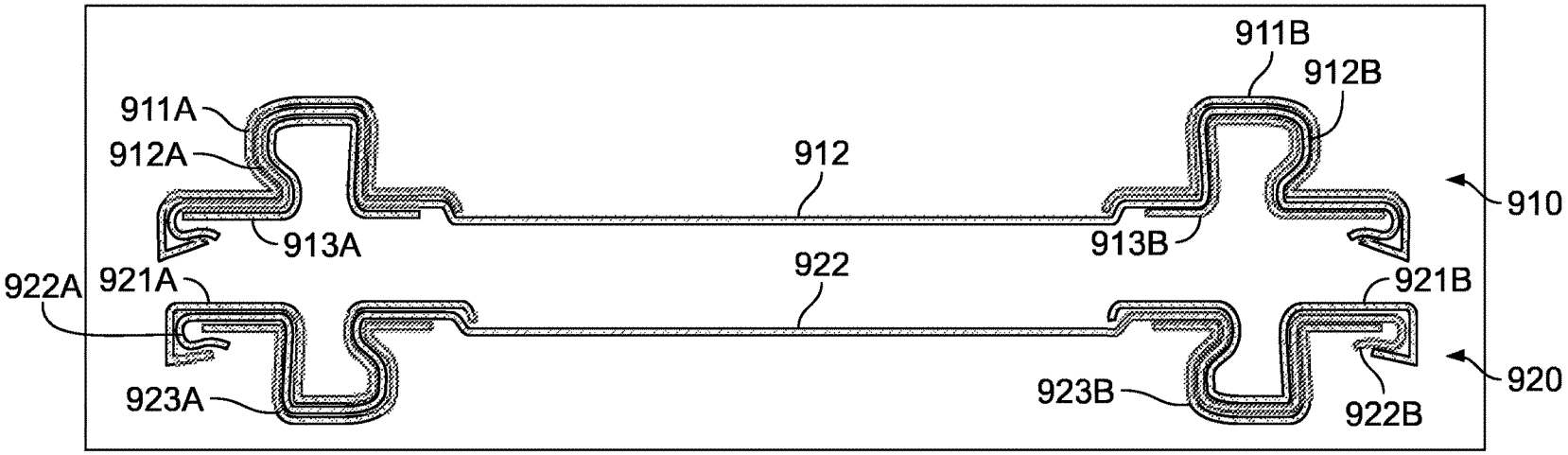
FIG. 9 is a schematic illustration of an elevation cross-sectional view of the curved press-fit options of male-fit and female-fit, in accordance with some embodiments.

FIG. 9 is a schematic illustration of a side cross-sectional view of the curved options of male-fit and female-fit, in accordance with some embodiments. According to some embodiments, the curved option includes male fit curved option sealing feature 910 and female fit curved option sealing feature 920, which have previously been discussed in FIGS. 7 and 8. FIG. 9 provides enlarged views of detailed structures of male fit and female fit curved options sealing features 910 and 920. As discussed in FIGS. 7 and 8, the flexible film 912 is sealed (912A/B) between curved top rim protrusions 913A/B and curved ring lid 911A/B with matching sizes and configurations. Similarly, the flexible film 922 is sealed (922A/B) between curved top rim recesses 923A/B and curved ring lid 921A/B with matching sizes and configurations.

Figure 10:
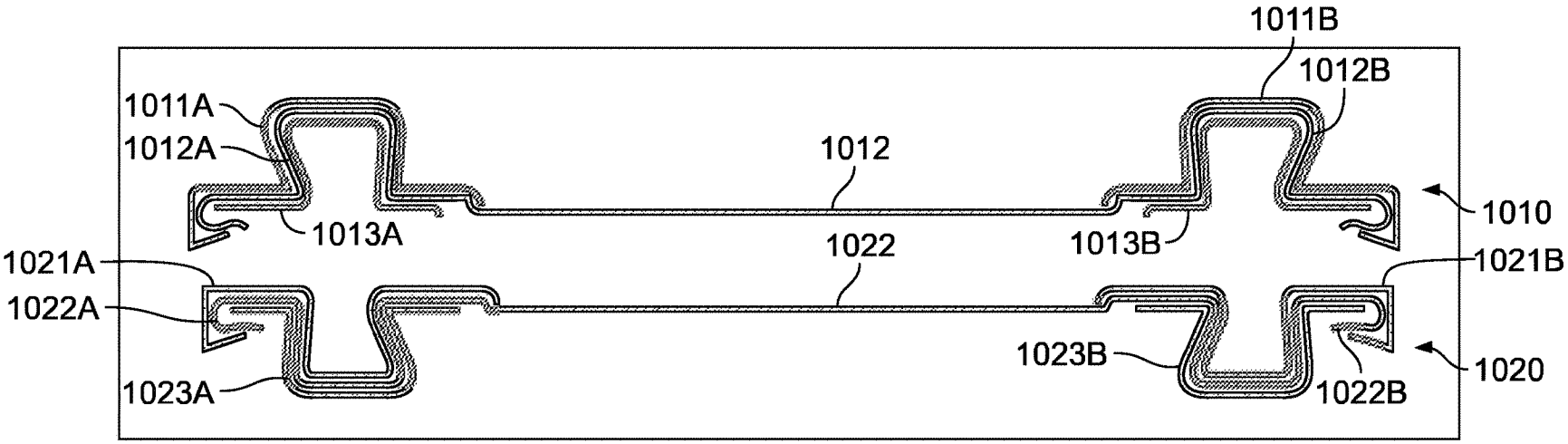
FIG. 10 is a schematic illustration of an elevation cross-sectional view of the angled press fit options of male-fit and female-fit, in accordance with some embodiments.

FIG. 10 is a schematic illustration of a side cross-sectional view of the angled options of male-fit and female-fit, in accordance with some embodiments. According to some embodiments, the curved option includes male fit curved option 1010 and female fit curved option sealing features 1020, which have previously been discussed in FIGS. 7 and 8. FIG. 10 provides enlarged views of detailed structures of male fit and female fit curved option sealing features 1010 and 1020. As discussed in FIGS. 7 and 8, the flexible film 1012 is sealed (1012A/B) between curved top rim protrusions 1013A/B and curved ring lid 1011A/B with matching sizes and configurations. Similarly, the flexible film 1022 is sealed (1022A/B) between curved top rim recesses 1023A/B and curved ring lid 1021A/B with matching sizes and configurations.

FIG. 11 is a schematic illustration of an elevation cross-sectional view of the gasket options of the angled option and the curved option, in accordance with some embodiments. According to some embodiments, as discussed in FIG. 6, in the female fit configuration, instead of implementing a matching ring lid, a matching gasket is implemented to press fit into the recess 602A/B on the top rim of the tray or tub 601. As illustrated in FIG. 11, in the curved option sealing feature 1110, the flexible film 1111 is sealed (1111A/B) between the curved recess 1112A/B on the top rim of the tray or tub and the gasket 1113A/B with matching size and configuration. Similarly, in the angled option sealing feature 1120, the flexible film 1121 is sealed (1121A/B) between the angled recess 1122A/B on the top rim of the tray or tub and the gasket 1123A/B with matching size and configuration. In the top view 1130, the gasket 1123 matches the size and shape of the underlying tray or tub covered by the film 1121. On the upper right corner, a pull-tab 1131 is implemented to engage or disengage the gasket 1123. The pull-tab 1131 will be discussed in more detail later. According to some embodiments, the gasket 1113A/B is made of a flexible material.

Figure 12:
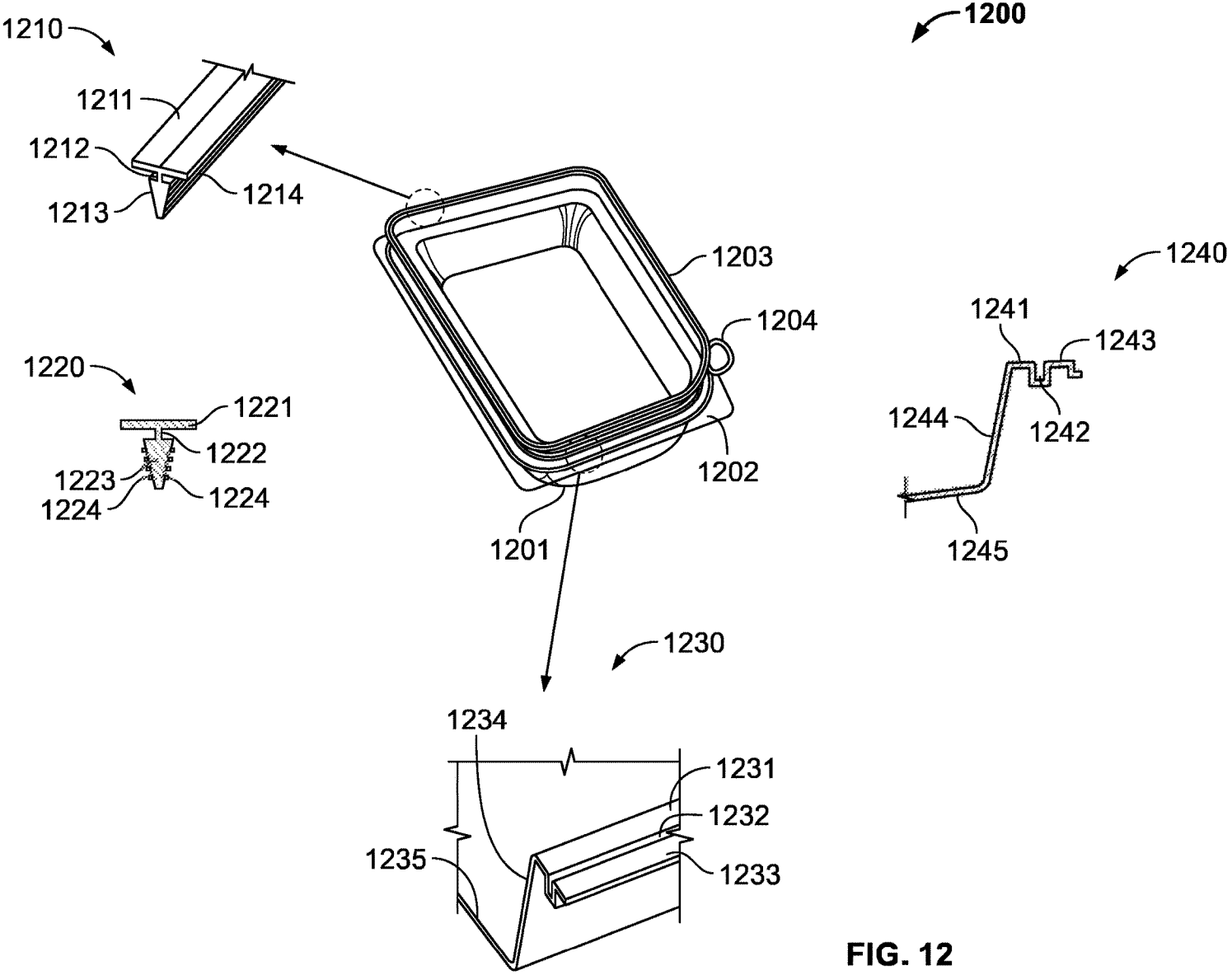
FIG. 12 is a schematic illustration of a perspective view of the three-piece press fit sealing package with enlarged view of the female-fit press fit option, in accordance with some embodiments.

FIG. 12 is a schematic illustration of a perspective view of the three-piece press fit sealing system with enlarged view of the friction-fit, in accordance with some embodiments. According to some embodiments, the three-piece press fit sealing system 1200 includes a tray or tub 1201, a flexible film 1202 and a friction-fit ring lid 1203 with a pull ring 1204. According to some embodiments, the pull ring 1204 is implemented inside the perimeter of the ring lid 1203. According to some embodiments, the pull ring 1204 is implemented outside the perimeter of the ring lid 1203. According to some embodiments, the pull ring 1204 is flexible, and thus can be implemented either inside or outside of the perimeter of the ring lid 1203 by flipping or folding of the pull ring 1204. The friction-fit ring lid 1203 is very similar to the female fit ring lid 500 illustrated in FIG. 5. The enlarged cross sectional view 1240 of the top rim of the tray or tub 1201 shows that the recess 1242 is very similar to the recesses 502AR/BR in FIG. 5. The recess (e.g., groove) 1242 corresponds to the recess 1232 in the perspective view 1230. The top rim 1241 and 1243 shown in the enlarged cross sectional view 1240 correspond to the top rim 1231 and 1233 in the perspective view 1230, and sidewall 1244 in the enlarged cross sectional view 1240 corresponds to sidewall 1234 in the perspective view 1230.

The enlarged perspective view 1210 of the friction-fit ring sealing feature shows a ring base 1211, a protrusion 1213, a connector 1212 connecting the ring base 1211 and the protrusion 1213, and on both sides of the protrusion 1213, a plurality of ribs 1214 may be deployed in parallel to increase friction when the protrusion 1213 is engaged into the groove 1232. In the cross sectional view 1220, on both sides of the protrusion 1223, a plurality of ribs 1224 may be deployed, the size and shape of the protrusion 1223 match the size and shape of the recess 1242 in cross sectional view 1240. According to some embodiments, the ring lid base 1211, the protrusion 1213, and the connector 1212 are made of a suitable material. According to some embodiments, the groove 1232 and the top rim 1231 and 1233 are made of a suitable material.

Figure 13:
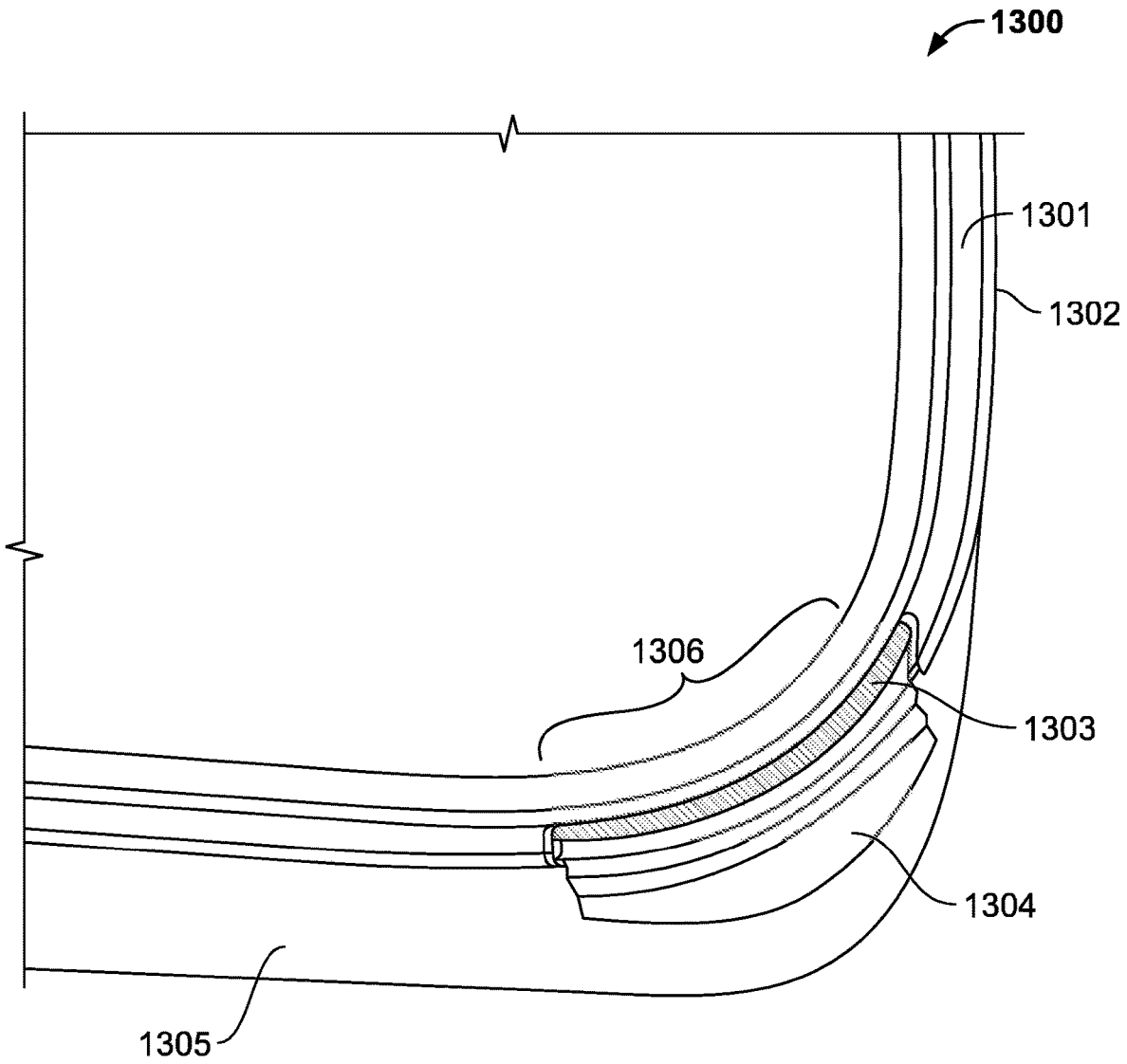
FIG. 13 is a schematic illustration of an enlarged perspective view of a release tab of the three-piece press fit sealing system in closed and locked position, in accordance with some embodiments.

FIG. 13 is a schematic illustration of an enlarged perspective view of a release tab of the three-piece press fit sealing system in a closed and locked position, in accordance with some embodiments. According to some embodiments, a raised protective corner tab 1303 is located at one of the four corners 1306 of the tray or tub body 1305. The extension 1304 of the corner tab 1303 is pulled up to lock the corner tab 1303 on the tray or tub 1305. To release the corner tab 1303 from the tray or tub 1305, the extension 1304 of the corner tab 1303 is pushed down. According to some embodiments, the ring lid 1301 has a locking lip 1302 bent around the top rim of the tray or tab body 1305 for locking the ring lid 1301 to the top rim of the tray or tab 1305. More details will be discussed below with respect to the description of FIG. 15.

Figure 14:
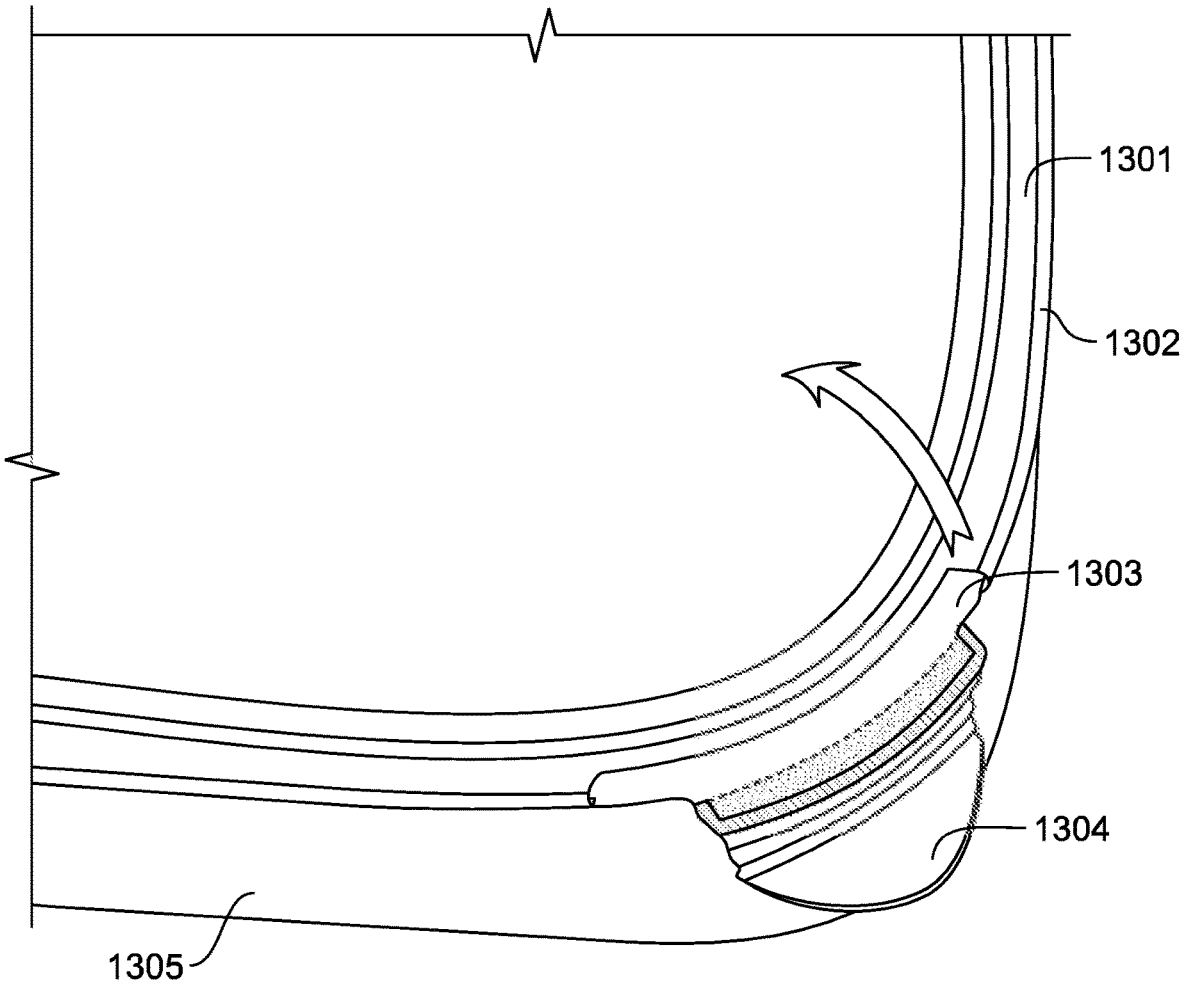
FIG. 14 is another schematic illustration of an enlarged perspective view of a release tab of the three-piece press fit sealing system in an open and unlocked position, in accordance with some embodiments.

FIG. 14 is another schematic illustration of an enlarged perspective view of a release tab of the three-piece press fit sealing system in an open and unlocked position, in accordance with some embodiments. According to some embodiments, to open and unlock the ring lid 1301, the extension 1304 of the corner tab 1303 is pressed down to release (unlock) the ring lid 1301 from the top rim of the tray or tab 1305. The protective corner tab 1303 is then peeled/angled away, popping off the ring lid 1301. When the ring lid 1301 is peeled up, the film is removed to expose the food product inside the tray or tub 1305. More details will be discussed below with respect to the description of FIG. 15.

Figure 15:
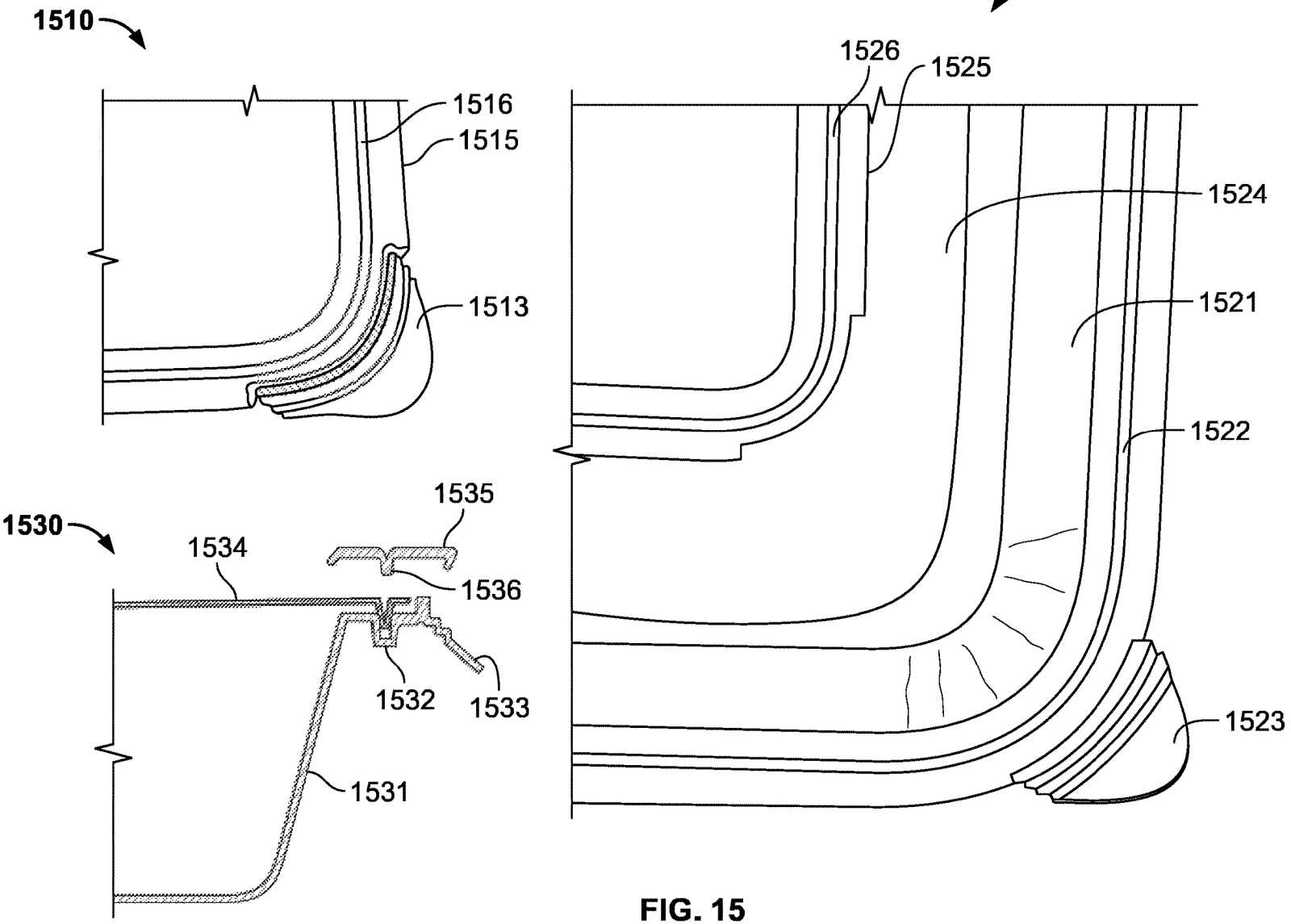
FIG. 15 is another schematic illustration of an enlarged view of a release tab of the three-piece press fit sealing system and an enlarged cross-sectional view, in accordance with some embodiments.

FIG. 15 is another schematic illustration of an enlarged view of a release tab of the three-piece press fit sealing system and an enlarged cross-sectional view, in accordance with some embodiments. According to some embodiments, 1530 is a cross sectional view of the corner of the ring lid with a corner tab. As illustrated in FIG. 15, 1531 is the tray or tub for holding food products, 1532 is the female fit on the top rim of the tray or tub 1531, the flexible film 1534 is sandwiched between the female fit 1532 and the ring lid 1535 with matching protrusions 1536. The ring lid 1535 with matching protrusions 1536 is pressed into the female fit 1532 to seal and lock the film 1534 on the top of the tray or tub 1531. Then the corner tab 1533 is flipped and rolled up around the ring lid 1535 to lock the ring lid 1535. In order to unlock the ring lid, the corner tab 1533 is rolled down to expose the ring lid 1535, then the ring lid 1535 can be peeled up and the film can be removed. In an enlarged view 1520, 1523 is the corner tab corresponding to 1533 in view 1530, the female fit 1522 corresponds to the female fit 1532 in the view 1530, the ring lid 1525 corresponds to 1535 in the view 1530, and the protrusions 1526 corresponds to the protrusions 1536. When the ring lid 1526 is pressed to fit the top of the tray or tub 1521 with the flexible film 1524 in between, the corner tab 1523 is rolled up and around the corner of the ring lid 1526 to seal and lock the ring lid 1526. The top view 1510 shows when the ring lid 1515 is pressed to fit the top of the tray or tub, with the corner tab 1513 ready to be rolled up and around the corner to seal and lock the ring lid.

Figure 16:
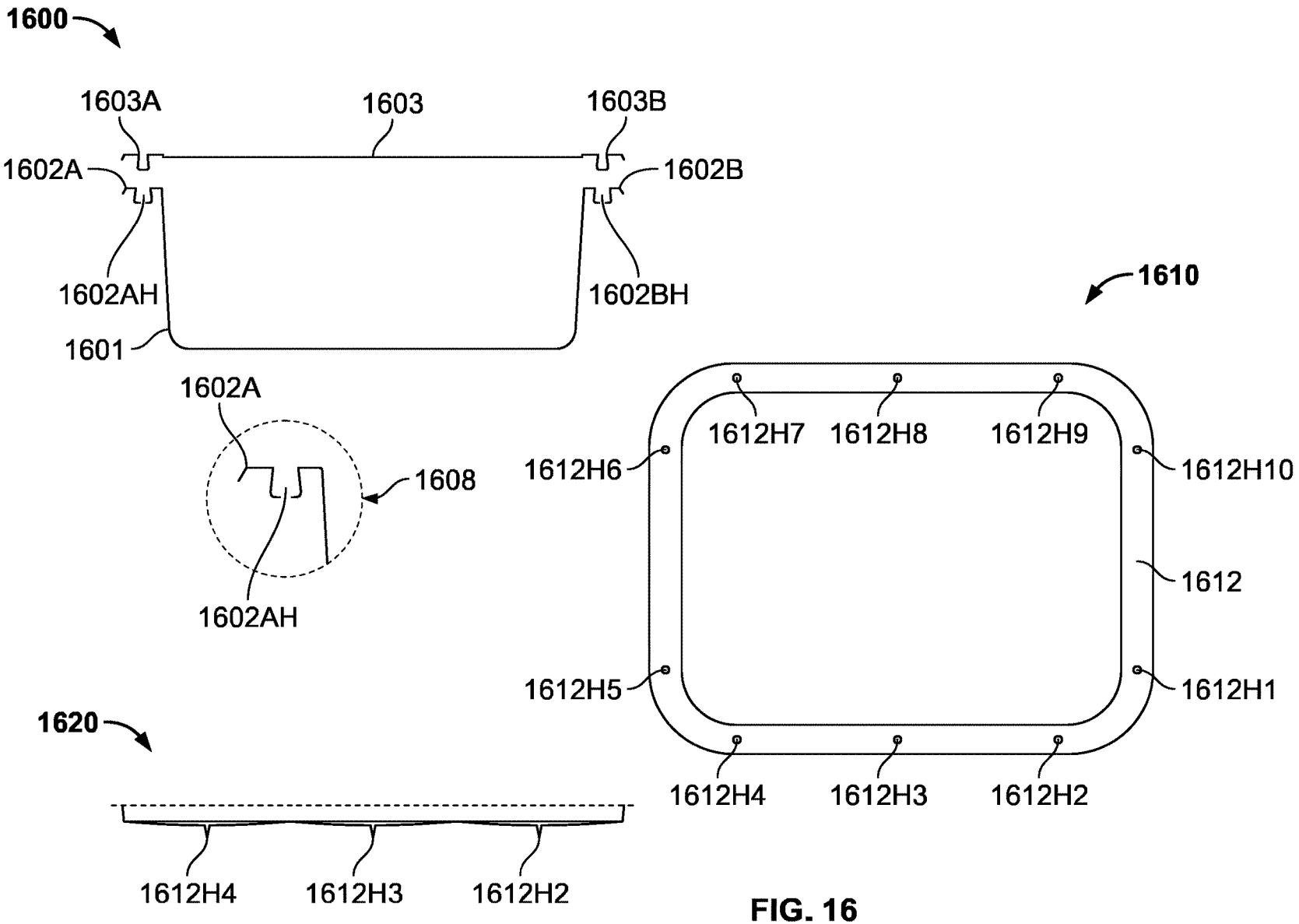
FIG. 16 is an illustration of another press fit sealing package with drain holes, in accordance with some embodiments.

FIG. 16 is an illustration of another press fit sealing package with drain holes, in accordance with some embodiments. According to some embodiments, the press fit sealing package 1600 includes a plurality of drain holes 1602AH/BH that are implemented on the bottom of the recess 1602A/B. An enlarged view 1608 illustrates the details of the drain hole 1602AH on the bottom of the recess 1602A. In the top view 1610, such drain holes are illustrated on recess 1612 as drain holes 1612H1, 1612H2, 1612H3, 1612H4, 1612H5, 1612H6, 1612H7, 1612H8, 1612H9, and 1612H10 on the bottom of the recess 1612. In an enlarged side view 1620 with drain holes 1612H2, 1612H3 and 1612H4, according to some embodiments, the bottom of the recess 1612 is sloped to facilitate the draining of liquid accumulated on the bottom of the recess 1612. For example, according to some embodiments the bottom areas surrounding the drain holes are sloped toward the closest drain holes. Press fit sealing package 1600 can include a ring lid (not shown) as discussed above (e.g., see FIG. 5) for sealing or locking flexible film element 1603 to the top of the tray 1601.

Figure 17:
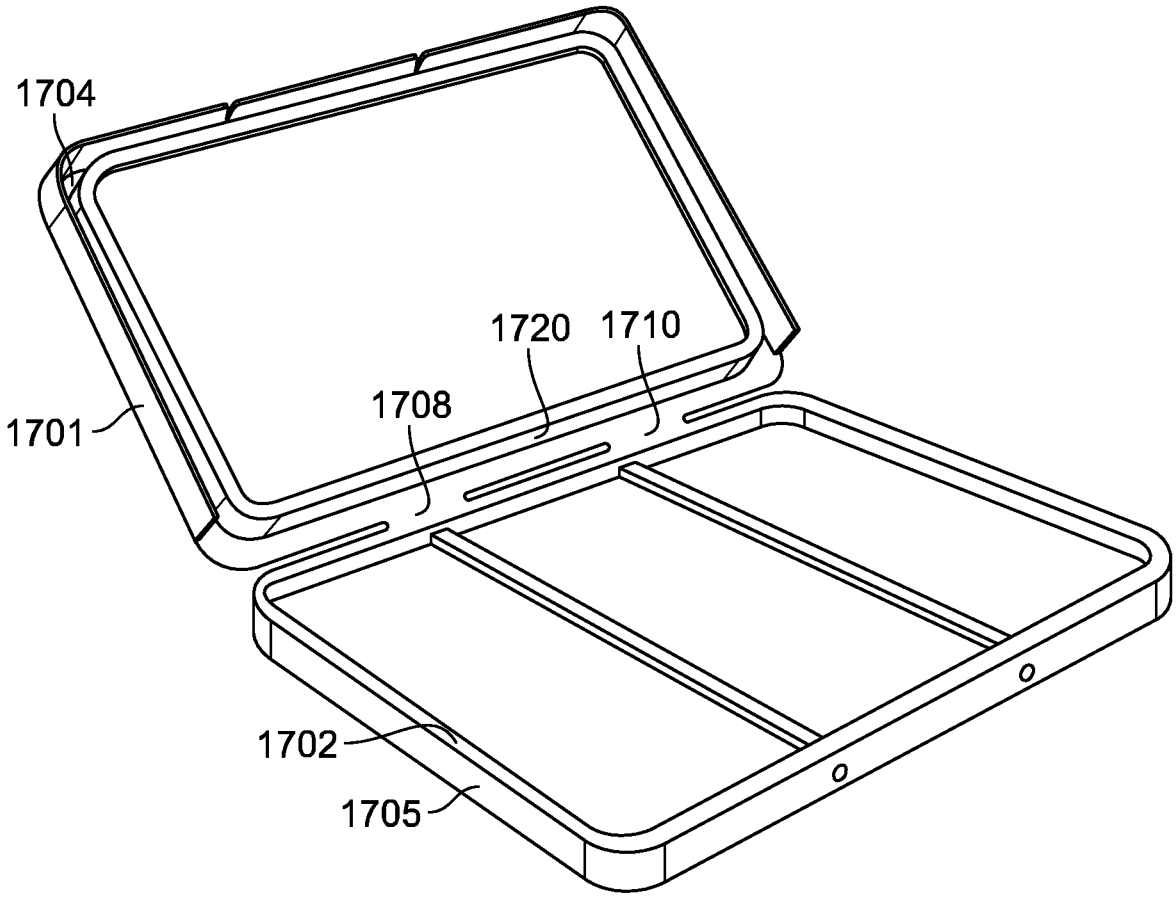
FIG. 17 is an illustration of another press fit sealing package with a hinged ring lid, in accordance with some embodiments.

FIG. 17 is an illustration of another press fit sealing package with a hinged ring lid, in accordance with some embodiments. Press fit sealing package 1700 includes ring lid 1701 and tray or tub body 1705. Ring lid 1701 can include channel 1704 and inner wall 1720 such that, when closed, ring lid 1701 fits over top rim 1702 of tray or tub body 1705. Press fit sealing package 1700 also includes one or more hinges 1708, 1710 that are attached to tray or tub body 1705. In some embodiments, the one or more hinges 1708, 1710 can be attached to the top rim 1702 of tray or tub body 1705. The hinges 1708, 1710 also attach to ring lid 1701 such that they allow ring lid 1701 to be deployed over top rim 1702 of tray or tub body 1705, for example by channel 1704 interfacing with top rim 1702. For example, ring lid 1701 can be deployed on the top of a film (not shown) to seal the film in place over tray or tub boy 1705.

In some embodiments, press fit sealing package 1700 can include an additional flexible film. For example, the additional flexible film may be a permanent film that is attached to the tray or tub body 1705 or the ring lid 1701. The additional flexible film may be attached using alternate sealing methods such as hot bar, impulse, induction, ultrasonic, and/or overwrapping sealing methods. This additional flexible film can allow increased tamper resistance, for example, or can provide protection to product within the tray or tub body 1705 from the atmosphere (e.g., a gas barrier, such as to prevent gasses, such as a modified atmosphere, from within the tray or tub body 1705 to escape). In some examples, the additional flexible film is attached to the ring lid 1701. For example, the additional flexible film can be wrapped over the ring lid 1701, or can be attached using a flow wrap operation. The additional flexible film can allow for brand identification, such as graphics or branding information that is located on the outside of the additional flexible film (e.g., viewable to the consumer).

It is important to note that the construction and arrangement of the elements of the products and methods as shown in the exemplary embodiments above are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the various embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure In addition, those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A package, comprising:

a tray having a base connected to a plurality of sidewalls each of which extends away from the base and terminates at a rim, said tray defining a volume with an opening circumscribed by said rim;

said rim comprising a press-fit sealing feature including a channel element;

a ring-shaped lid comprising a complimentary press-fit sealing feature including a ridge element configured to removably mate inside the channel element;

a product disposed in said volume wherein said product surface comprises at least one contour; and a flexible film, wherein said flexible film spans said opening, wherein said flexible film is secured to said tray between said press-fit sealing feature of the rim and said complimentary press-fit sealing feature of the ring-shaped lid, and wherein the channel element comprises two sidewalls and a bottom that comprises at least one drain hole such that a cross-sectional profile of the channel element at the drain hole defines a U-shaped profile with the two sidewalls and the bottom, wherein the U-shaped profile comprises a width extending between the two sidewalls, and wherein the bottom of the channel element is sloped towards the at least one drain hole and is sloped in a direction perpendicular to the width.

2. The package of claim 1 wherein the securing of said flexible film to said tray results in the tray being airtight and water tight.

3. The package of claim 1 wherein said flexible film is secured to said tray without the addition of heat to the package.

4. The package of claim 1 wherein said tray comprises a flexible material and said product is visible through said flexible film, said flexible material, or said flexible film and said flexible material.

5. The package of claim 1 wherein said product protrudes from the volume past said opening and said flexible film adheres to the at least one contour of the product surface.

6. The package of claim 1 wherein said ridge element projects toward said base on said ring-shaped lid.

7. The package of claim 1 further comprising a ring-pull device attached to said ring-shaped lid for unsealing said package.

8. The package of claim 7 further comprising a corner tab feature on said ring-shaped lid, wherein said corner tab is displaceable to access said ring-pull device.

9. The package of claim 1 further comprising at least one hinge attaching the ring-shaped lid to the tray.

10. A package, comprising:

a tray having a base connected to a plurality of sidewalls each of which extends away from the base and terminates at a rim, said tray defining a volume with an opening circumscribed by said rim;

said rim comprising a press-fit sealing feature having a channel;

a gasket configured to be removably retained within said channel;

a product disposed in said volume wherein said product surface comprises at least one contour; and a flexible film, wherein said flexible film spans said opening, wherein said flexible film is secured to said tray between said press-fit sealing feature of the rim and said gasket, and wherein the channel comprises two sidewalls and a bottom that comprises at least one drain hole such that a cross-sectional profile of the channel element at the drain hole defines a U-shaped profile with the two sidewalls and the bottom, wherein the U-shaped profile comprises a width extending between the two sidewalls, and wherein the bottom of the channel is sloped towards the at least one drain hole and is sloped in a direction perpendicular to the width.

11. The package of claim 10 wherein the securing of said flexible film to said tray results in the tray being airtight and water tight.

12. The package of claim 10 wherein said flexible film is secured to said tray without the addition of heat to the package.

13. The package of claim 10 wherein said product is visible through said flexible film, said tray, or said flexible film and said tray.

14. The package of claim 10 wherein said product protrudes from the volume past said opening and said flexible film adheres to the at least one contour of the product surface.

15. The package of claim 10 further comprising a ring-pull device attached to said gasket for unsealing said package.

16. A method for storing a product contained within a storage package, comprising:

providing a tray having a base connected to a plurality of sidewalls each of which extends away from the base and terminates at a rim, said tray defining a volume with an opening circumscribed by said rim, said rim comprising a press-fit sealing feature including a channel element, the channel element comprising two sidewalls and a bottom that comprises at least one drain hole such that a cross-sectional profile of the channel element at the drain hole defines a U-shaped profile with the two sidewalls and the bottom, wherein the U-shaped profile comprises a width extending between the two sidewalls, and wherein the bottom of the channel element is sloped towards the at least one drain hole and is sloped in a direction perpendicular to the width;

providing a ring-shaped lid comprising a complimentary press-fit sealing feature including a ridge element configured to removably mate inside the channel element of said press-fit sealing feature;

placing the product in said volume wherein said product surface comprises at least one contour; and providing a flexible film, wherein said flexible film spans said opening, and securing said flexible film to said tray between said press-fit sealing feature of the rim and said complimentary press-fit sealing feature of the ring-shaped lid.

17. The method of claim 16 wherein the securing of said flexible film to said tray results in the tray being airtight and water tight.

18. The method of claim 16 wherein the securing of said flexible film to said tray is without the addition of heat to the storage package.

19. The method of claim 16 wherein said product is visible through said flexible film, said tray, or said flexible film and said tray.

20. The method of claim 16 wherein said product protrudes from the volume past said opening and adheres to the at least one contour of the product surface.

21. The method of claim 16 further comprising a ring-pull device attached to said ring-shaped lid for unsealing said package.

22. The method of claim 21 further comprising a corner tab feature on said ring-shaped lid, wherein said corner tab is displaceable to access said ring-pull device.

23. The method of claim 16 further comprising: removing the flexible film from the storage package; and providing a second flexible film, and securing said second flexible film to said tray between said press-fit sealing feature of the rim and said complimentary press-fit sealing feature of the ring-shaped lid.

24. The method of claim 16 comprising securing an additional flexible film over the ring-shaped lid.

* * * * *